US005743402A

United States Patent [19]

Gics

[11] Patent Number: 5,743,402

[45] Date of Patent: Apr. 28, 1998

[54] FOOD PACKAGE INCLUDING A TRAY AND A SLEEVE

[75] Inventor: Paul W. Gics, Sewickley Heights, Pa.

[73] Assignee: Gics & Vermee, L.P., Sewickley, Pa.

[21] Appl. No.: 819,889

[22] Filed: Mar. 18, 1997

[51] Int. Cl.[6] ..... B65D 85/00

[52] U.S. Cl. ..... 206/459.5; 206/548; 229/87.08; 229/902

[58] Field of Search ..... 206/434, 459.5, 206/460, 541, 548; 229/87.08, 902, 903, 905, 906

[56] References Cited

U.S. PATENT DOCUMENTS

| | | | |
|---|---|---|---|
| 3,126,660 | 3/1964 | Meyers . | |
| 3,183,100 | 5/1965 | Bonini . | |
| 3,281,051 | 10/1966 | O'Brien et al. . | |
| 3,349,985 | 10/1967 | Salway . | |
| 3,412,889 | 11/1968 | Eicholtz et al. . | |
| 3,580,466 | 5/1971 | Thelen . | |
| 3,759,378 | 9/1973 | Werth | 206/434 |
| 4,013,798 | 3/1977 | Goltsos . | |
| 4,221,320 | 9/1980 | Faller . | |
| 4,671,453 | 6/1987 | Cassidy | 206/434 |
| 4,787,509 | 11/1988 | Pasternicki | 206/460 |
| 4,821,884 | 4/1989 | Griffin et al. | 229/902 |
| 4,939,332 | 7/1990 | Hahn . | |
| 5,032,213 | 7/1991 | Thomas, Jr. . | |
| 5,060,800 | 10/1991 | Bodet et al. . | |
| 5,090,615 | 2/1992 | Hopkins et al. . | |
| 5,119,940 | 6/1992 | Grindrod | 229/87.08 |
| 5,123,527 | 6/1992 | Hustad . | |
| 5,234,159 | 8/1993 | Lorence et al. . | |
| 5,263,633 | 11/1993 | Bicksler, III et al. | 229/87.08 |
| 5,326,575 | 7/1994 | Spaulding . | |
| 5,356,649 | 10/1994 | LaMotta et al. . | |
| 5,370,883 | 12/1994 | Saunier . | |
| 5,492,703 | 2/1996 | Gics . | |
| 5,657,873 | 8/1997 | Hustad et al. | 206/764 |

FOREIGN PATENT DOCUMENTS

| | | |
|---|---|---|
| 0399981 | 11/1990 | European Pat. Off. . |
| 0492052 | 7/1992 | European Pat. Off. . |
| 8604880 | 8/1996 | Germany . |
| 8604880 | 8/1986 | WIPO . |

*Primary Examiner*—David T. Fidei

*Attorney, Agent, or Firm*—David V. Radack; Eckert Seamans Cherin & Mellott, LLC

[57] ABSTRACT

A food package for containing a food product. The food package includes a tray having a base with an outer surface and an inner surface and a sidewall extending from the base. The sidewall has outer surface and an inner surface and defines a tray opening. A sleeve is provided which includes (i) a bottom section disposed adjacent the outer surface of the base; (ii) a side section disposed adjacent the outer surface of the sidewall; and (iii) a top section secured to the sidewall and substantially covering the tray opening. In another embodiment, a plastic film is interposed between the tray and the sleeve.

46 Claims, 8 Drawing Sheets

FOOD PACKAGE INCLUDING A TRAY AND A SLEEVE

BACKGROUND OF THE INVENTION

This invention relates to a food package including a tray and a sleeve.

Food packaging for fresh items, such as ground beef, typically involves providing a styrofoam tray on which the food product is supported, which is then wrapped by a plastic wrap. There are several disadvantages with this package, not the least of which is that the package tends to leak and does not provide sufficient labelling space.

My U.S. Pat. No. 5,492,703 provides a food package including a food package tray partially surrounded by a food package jacket. With this package, there is a separate lid and a separate jacket that each must be secured to the food package tray.

What is needed, however, is a food package which overcomes the problems of the prior art food packages and which is easy to manufacture and ship as well as which provides an attractive facing in the store.

SUMMARY OF THE INVENTION

The food package of the invention has met or exceeded the above-mentioned needs as well as others. In one embodiment, the food package comprises a tray having a base with an outer surface and an inner surface which defines a tray opening and a sleeve. The sleeve includes a bottom section disposed adjacent the outer surface of the base, a side section disposed adjacent the outer surface of the sidewall and a top section secured to the sidewall and substantially covering the tray opening.

In another embodiment, the food package comprises a tray having a base and a sidewall extending from the base, the sidewall defining an opening, and a plastic film secured to the tray for substantially covering the tray opening. The food package also includes a sleeve having a bottom section disposed adjacent to the base, a side section disposed adjacent the sidewall and a top section adjacent to and secured to the plastic film.

BRIEF DESCRIPTION OF THE DRAWINGS

A full understanding of the invention can be gained from the following detailed description of the invention when read in conjunction with the accompanying drawings in which.

DETAILED DESCRIPTION OF THE PREFERRED EMBODIMENT

Figure 1:
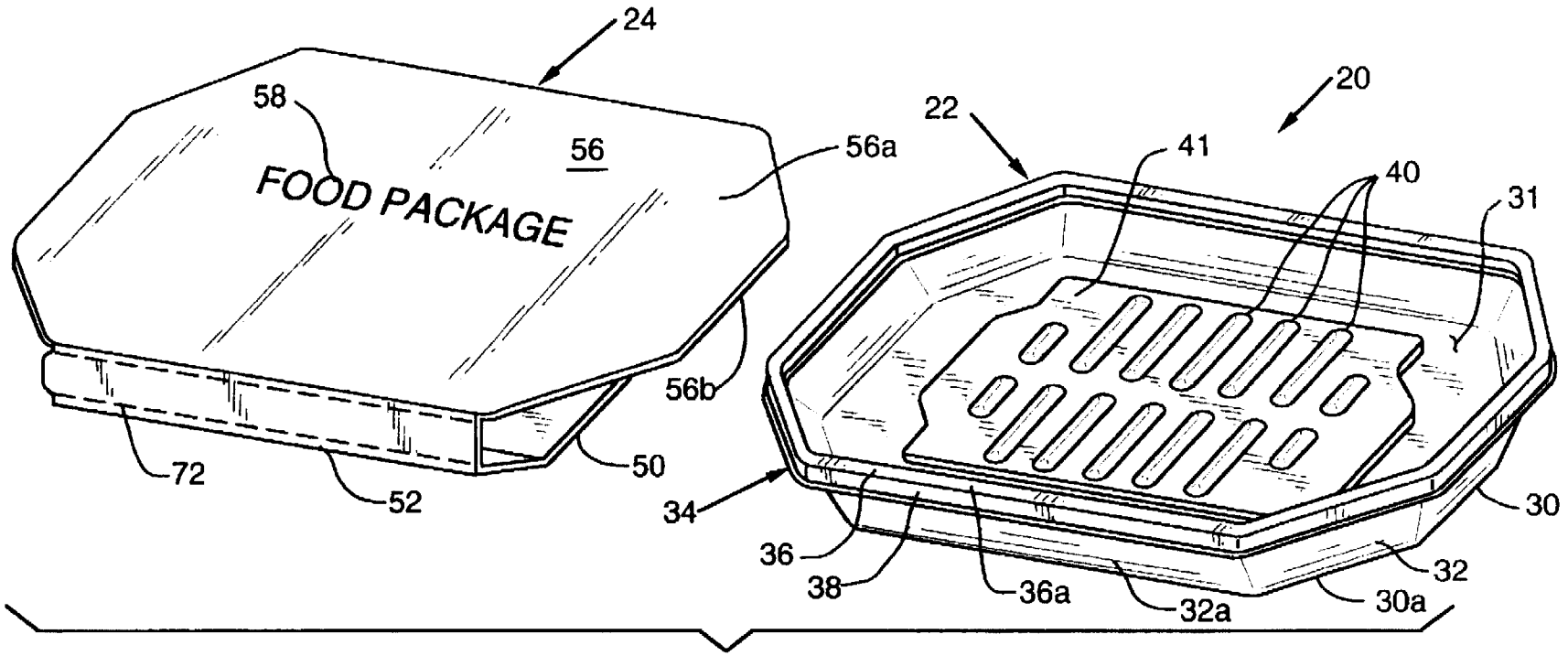
FIG. 1 is an exploded perspective view of one embodiment of the food package of the invention.
Figure 2:
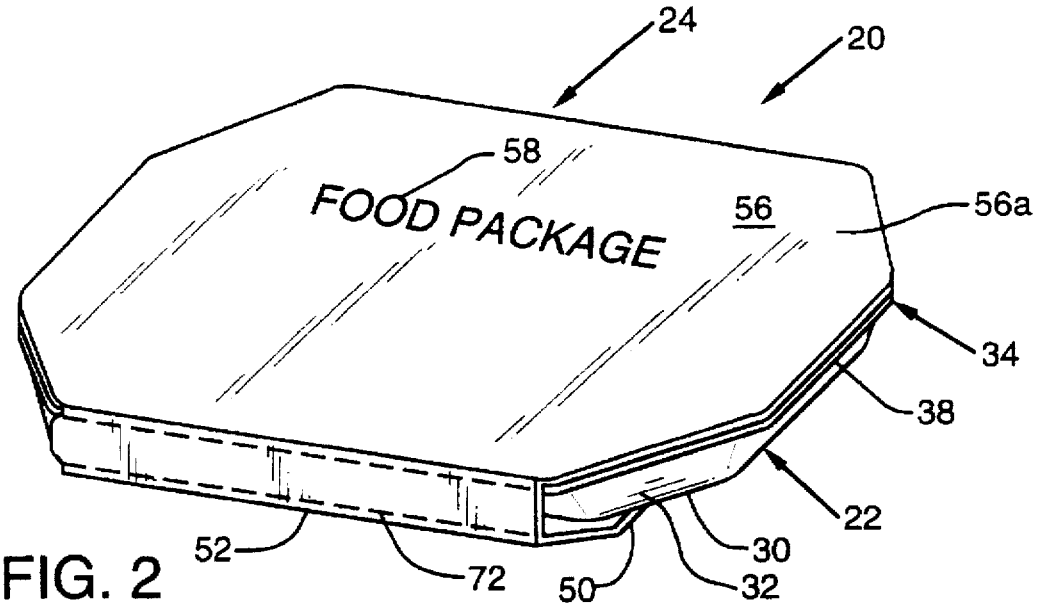
FIG. 2 is a perspective view of the food package of FIG. 1, as assembled.
Figure 3:
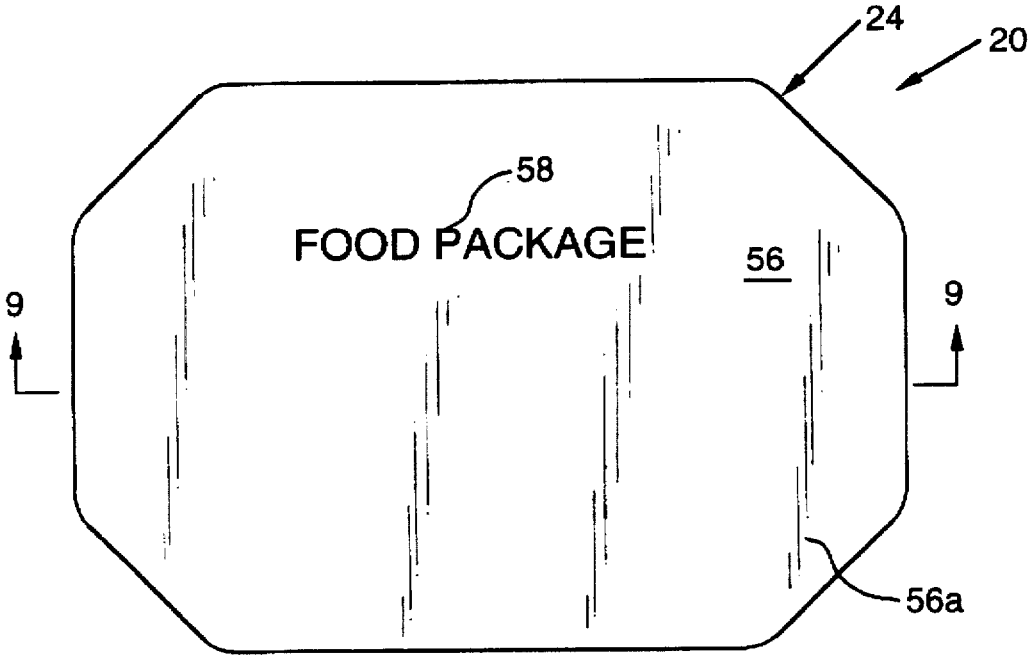
FIG. 3 is a top plan view of the food package of FIG. 2.
Figure 4:
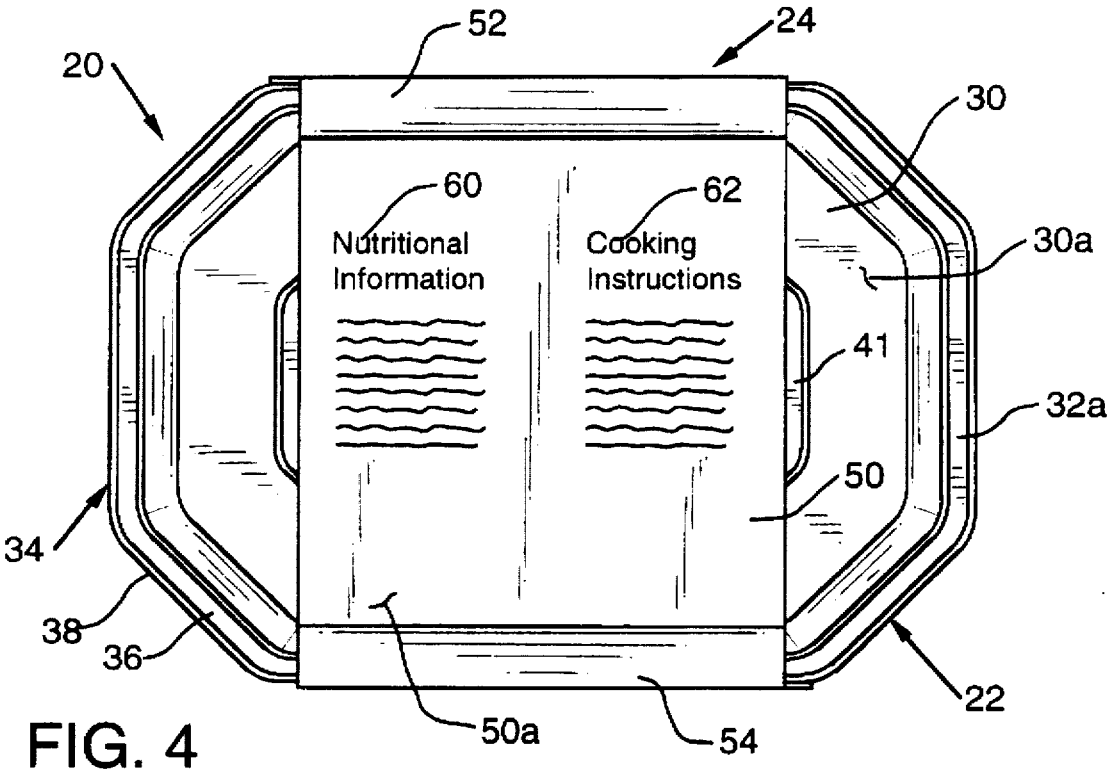
FIG. 4 is a bottom plan view of the food package of FIG. 2.
Figure 5:
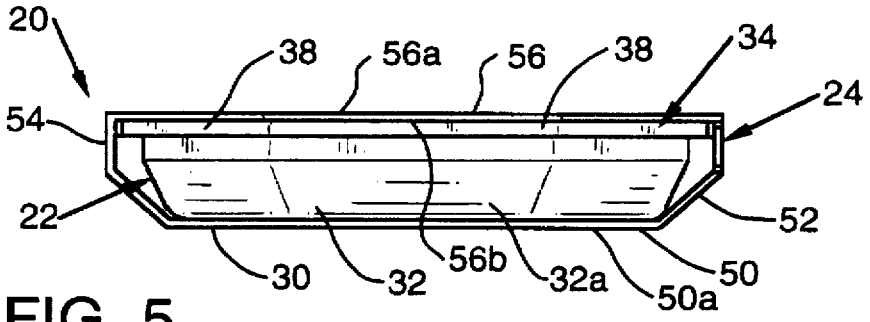
FIG. 5 is a left side elevational view of the food package of FIG. 2.
Figure 6:
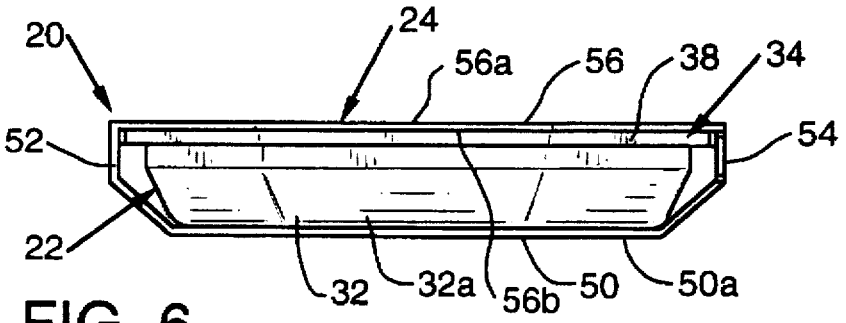
FIG. 6 is a right side elevational view of the food package of FIG. 2.
Figure 7:
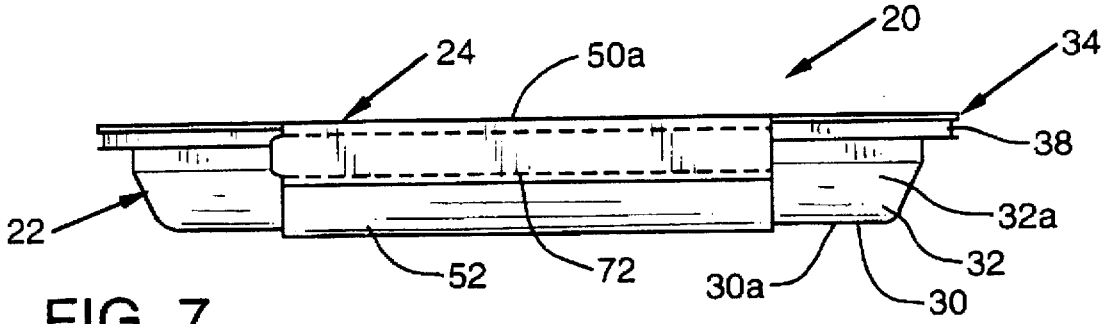
FIG. 7 is a front elevational view of the food package of FIG. 2.
Figure 8:
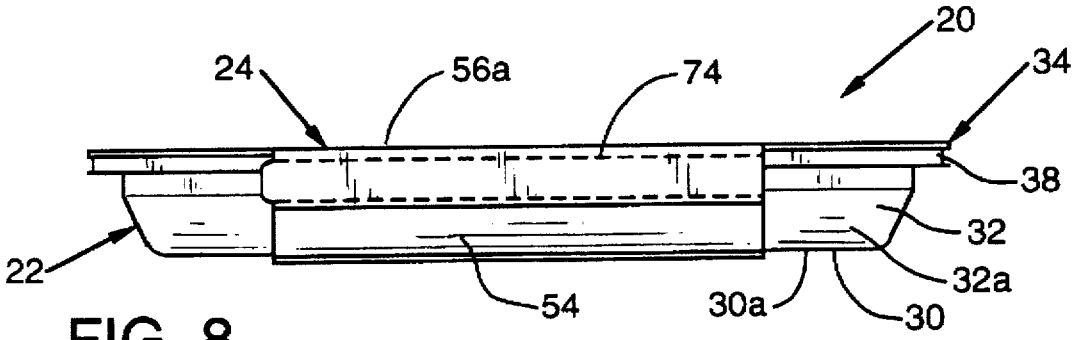
FIG. 8 is a back elevational view of the food package of FIG. 2.
Figure 9:
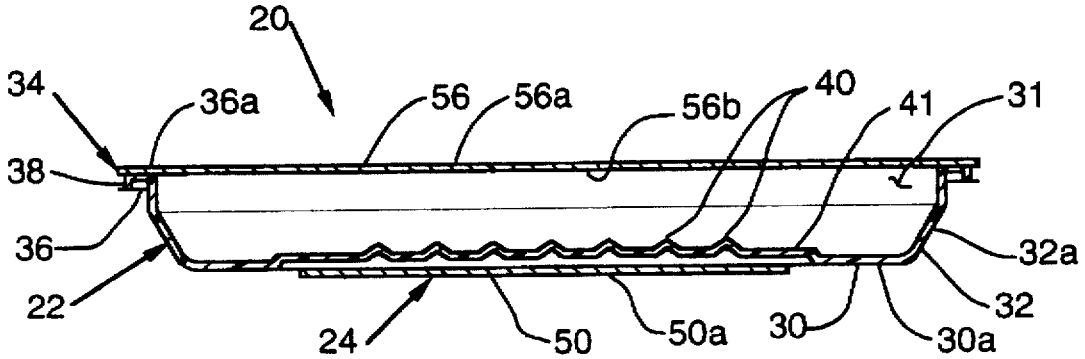
FIG. 9 is a cross-sectional view taken along line 9—9 of FIG. 3.
Figure 10:
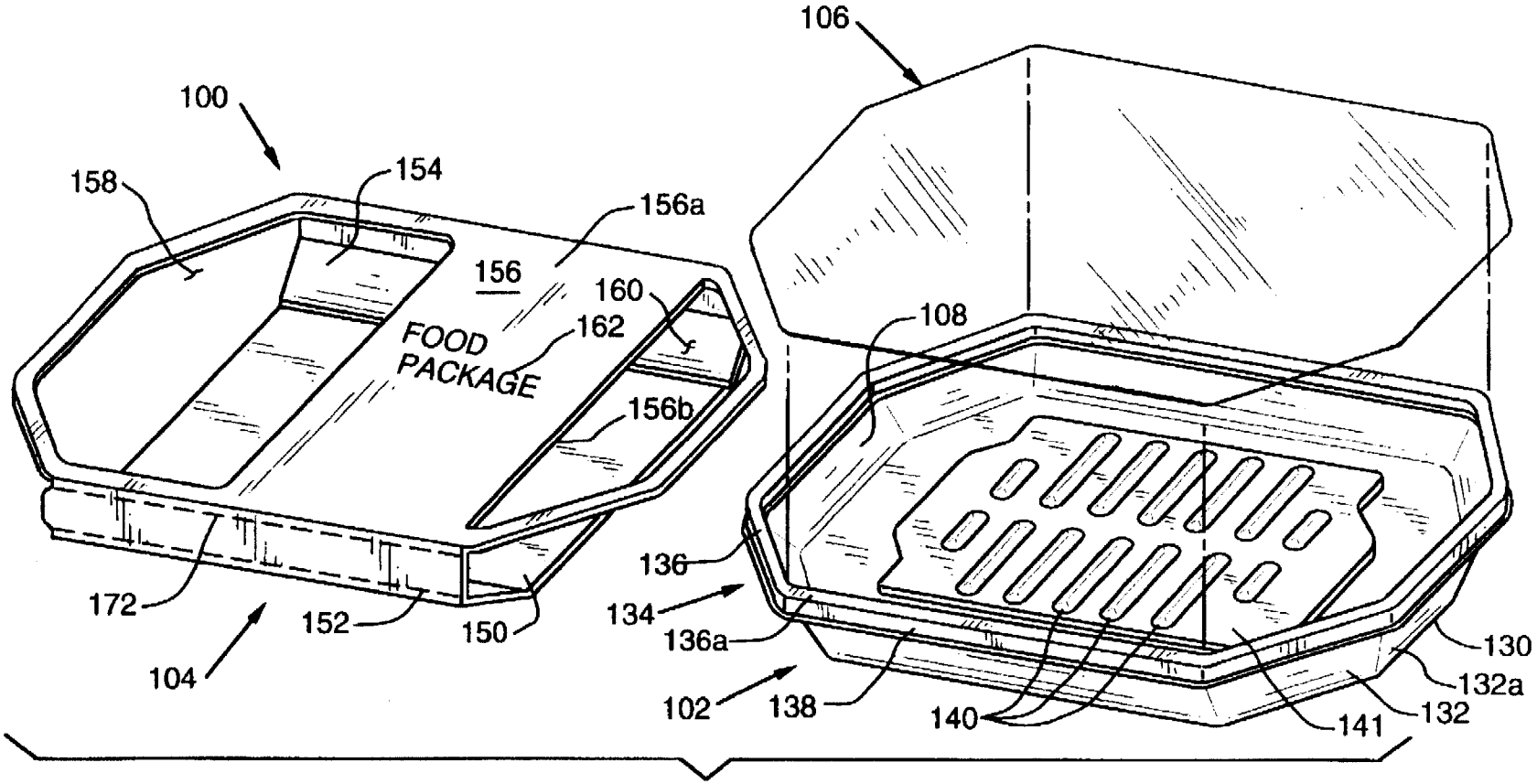
FIG. 10 is an exploded perspective view of another embodiment of the food package of the invention.

Referring now to FIGS. 1–9, an embodiment of the food package of the invention is shown. The food package 20 consists of a tray 22 and a sleeve 24. The tray 22 can be made of any suitable material, however, it is preferred that the tray 22 is made of plastic, and most preferably crystallized polyethylene terephlalate ("C-PETE") although other plastics, such as polypropylene can be used. The sleeve 24 can also be made of any suitable material, but preferably is made of paperboard.

The plastic tray 22 has a base 30 and a sidewall 32 extending from the base 30. The tray 22 defines a tray opening 31. The plastic tray 22 shown in FIGS. 1-9 has a generally octagonal shape, although it will be appreciated that any shape (rectangular, circular, oval) can be used depending on both functional and aesthetic requirements. In this particular embodiment, the sidewall 32 terminates in a flange 34 having a first portion 36 extending generally perpendicularly from the sidewall 32 and a second portion 38 extending generally perpendicularly from the first portion 36. The first portion 36, therefore, includes a flat upper surface 36*a* whose purpose will be explained further hereinbelow. The base 30 includes several protrusions 40, disposed on an elevated base portion 41. These protrusions 40 and the elevated base portion 41 provide air gaps which enhance the cooking of the food (not shown) in the package as was explained in my U.S. Pat. No. 5,484,984, the disclosure of which is incorporated herein by reference.

It is preferred that the plastic tray 22 be integrally formed by a molding process, although the tray 22 may be made in separate components and secured together in order to form the tray 22. Also, although flange 34 is shown, the sidewall 32 need not terminate in that particular type of flange but may terminate in a different shaped flange or no flange at all.

The sleeve 24 includes a bottom section 50 disposed adjacent to an outer surface 30*a* of the base 30, and two side sections 52 and 4 disposed adjacent to two separate sections of outer surface 32*a* of the sidewall and top section 56. The top section 56 includes an outer surface 56*a* and an inner surface 56*b*. Indicia such as the words "FOOD PACKAGE" 58 are printed or otherwise disposed on the outer surface 56*a*. It will be appreciated that the indicia can also include pleasing graphics or colors to make the package 20 more attractive to a potential consumer. Advantageously, the outer surface 50*a* of the bottom section 50 (FIG. 4) can be used to place other indicia, such as "NUTRITIONAL INFORMA- TION" 60 (which may be mandated by local food labelling laws), as well as "COOKING INSTRUCTIONS" 62, which may be desired to be placed on the food package 20. In this way, the more prosaic information either required or desired to be placed on the sleeve 24 can be printed on the outer surface 50*a* of bottom section 50, leaving the outer surface 56*a* of top section 56 free for containing more eye-catching graphics and colors.

The top section 56 can be secured to the plastic tray 22 by any suitable means, but it is preferred to use a hot melt adhesive applied directly to portions of the inner surface 56*b* of the top section 56 corresponding to the first portion 36 of the flange 34. The food packaging process can be any suitable process, but preferably the plastic tray 22 is filled with a food product (not shown) and the sleeve 24 is slid onto the tray 22. Once the sleeve 24 is in position, a heated die will contact the outer surface 56*a* of the top section 56, causing the hot melt adhesive to bond to the flat upper surface 36*a* of the first portion 36 of flange 34, thus securing the sleeve 24 to the plastic tray 22 (see FIG. 9). It will be appreciated that the heated die will be at a temperature low enough to prevent affecting the graphics on the sleeve yet high enough to effect melting of the hot melt adhesive.

In order to gain access to the food product, the invention contemplates providing at least one tear strip in order to remove the sleeve 24 from the plastic tray. Referring to FIGS. 1, 2, 7 and 8, tear strips 72 and 74 are provided on side sections 52 and 54 respectively. Removing tear strips 72 and 74 will remove the side sections 52 and 54 as well as bottom section 50. The top section 56 can be removed by any known method, such as providing score lines and a thumb hole, as shown in U.S. Pat. No. 5,492,703, the disclosure of which is incorporated by reference herein.

Referring now to FIGS. 10–18, another embodiment of the invention will be discussed. This food package 100 consists of a tray 102, a sleeve 104 and an interposed clear plastic film 106. The tray 102 is similar to tray 22 shown in FIGS. 1–9 and is made of C-PETE although it too can be made of any plastic material, such as polypropylene. The sleeve 104, similar to sleeve 24, is made of paperboard, however, sleeve 104 (as will be explained below) does not completely cover the tray opening 108 defined by the tray 102. In this embodiment, a clear plastic film 106 is secured to the tray 102 (as will be explained below) and the sleeve 104 design permits viewing of the food product (not shown) by a consumer.

The plastic tray 102 has a base 130 and a sidewall 132 extending from the base 130. The sidewall 132 terminates in a flange 134 having a first portion 136 extending generally perpendicularly from the sidewall 132 and a second portion 138 extending generally perpendicularly from the first portion 136. The first portion 136, therefore, includes a flat upper surface 136*a*. The base 130 also includes several protrusions 140 disposed on an elevated base portion 141.

Figure 11:
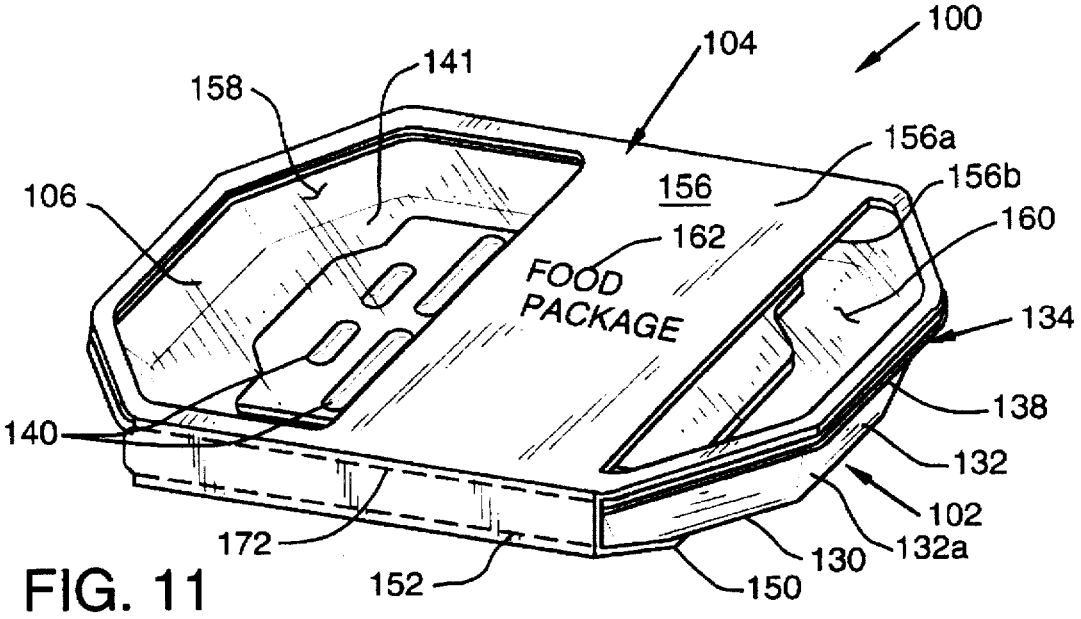
FIG. 11 is a perspective view of the food package of FIG. 10 as assembled.
Figure 12:
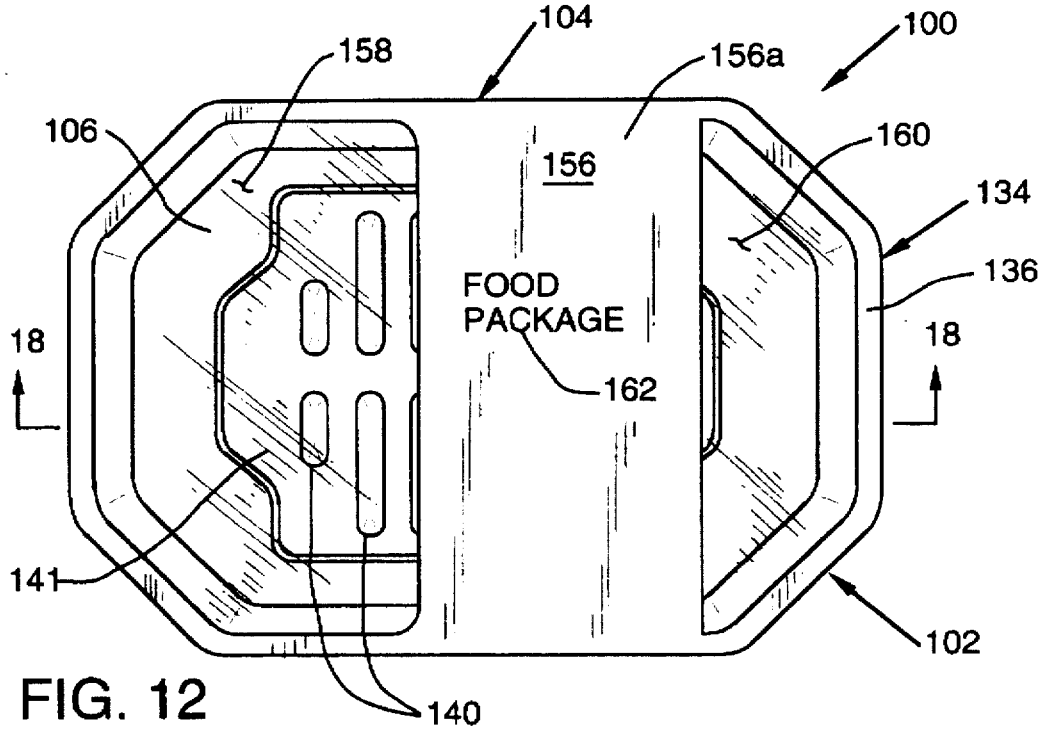
FIG. 12 is a top plan view of the food package of FIG. 11
Figure 13:
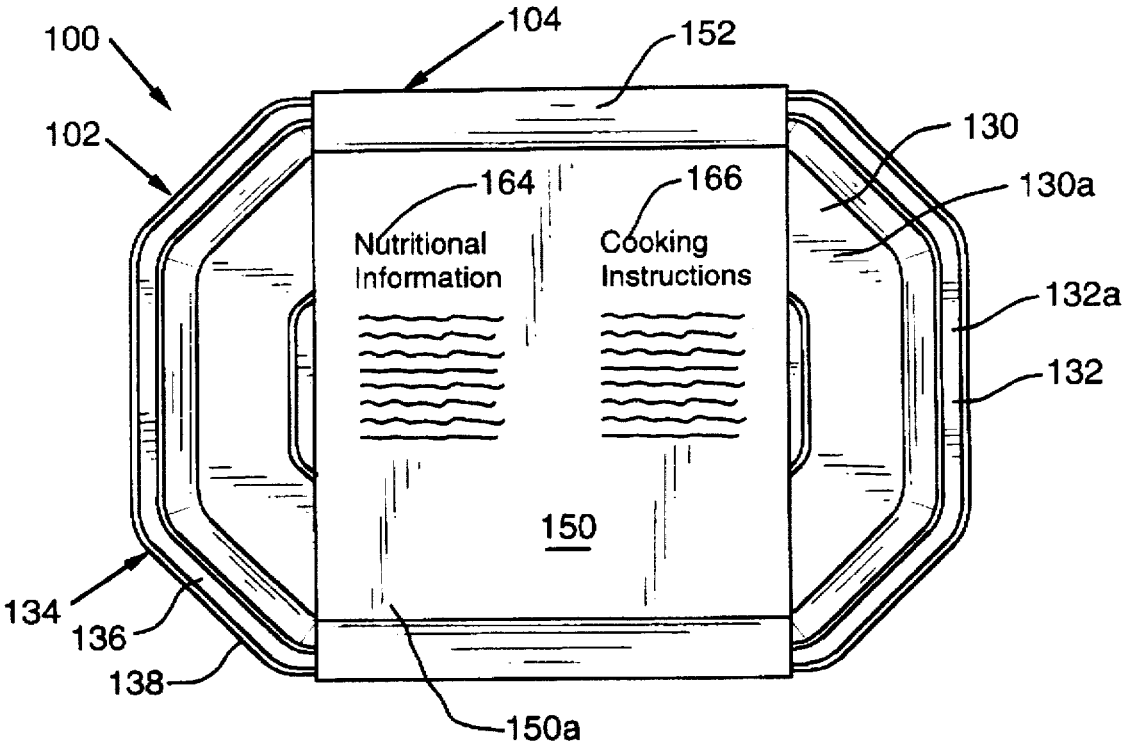
FIG. 13 is a bottom plan view of the food package of FIG. 11.
Figure 14:
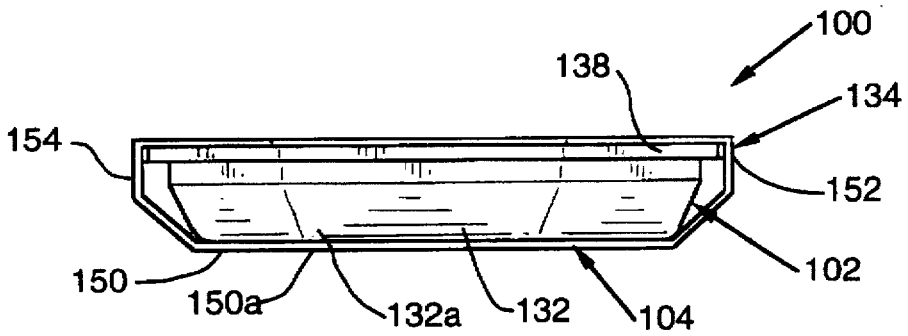
FIG. 14 is a left side elevational view of the food package of FIG. 11.
Figure 15:
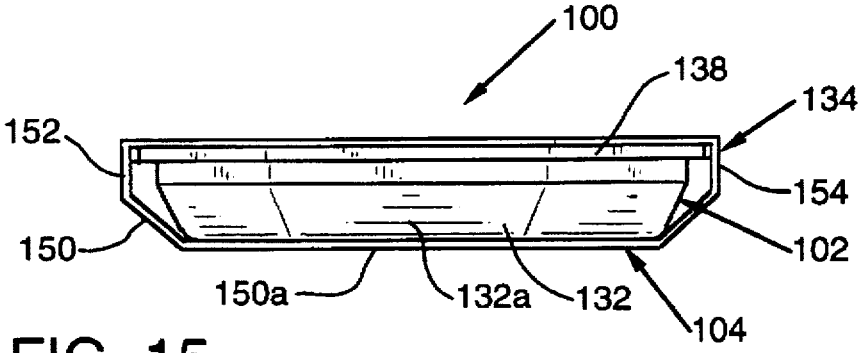
FIG. 15 is a right side elevational view of the food package of FIG. 11.
Figure 16:
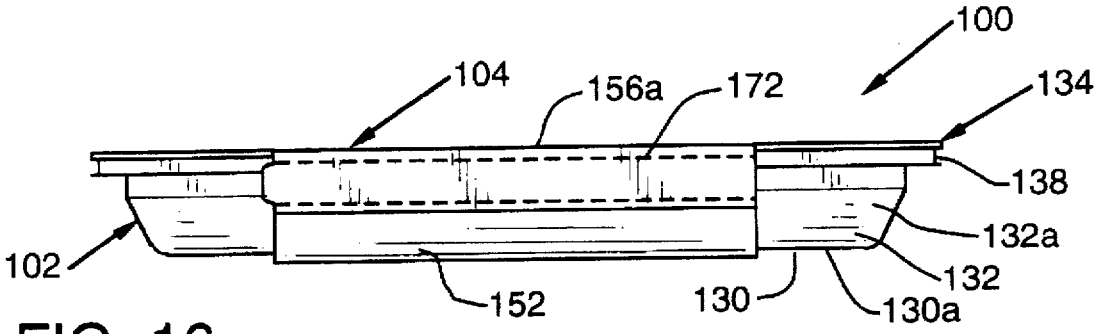
FIG. 16 is a front elevational view of the food package of FIG. 11.
Figure 17:
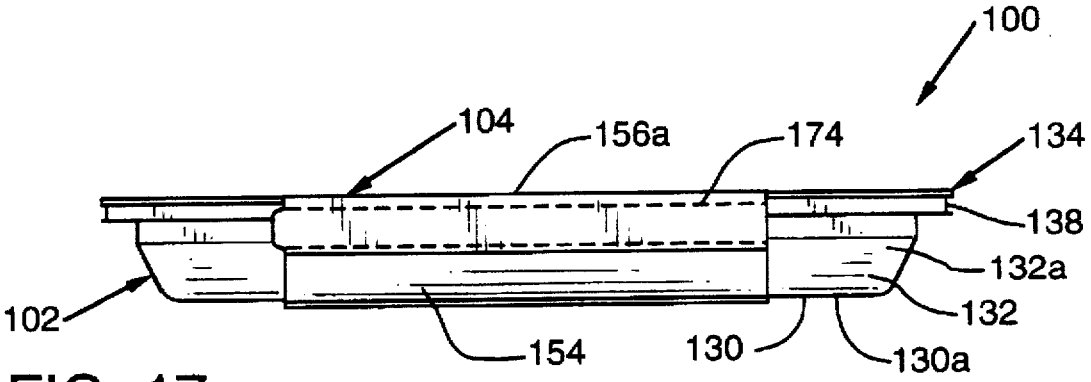
FIG. 17 is a back elevational view of the food package of FIG. 11.
Figure 18:
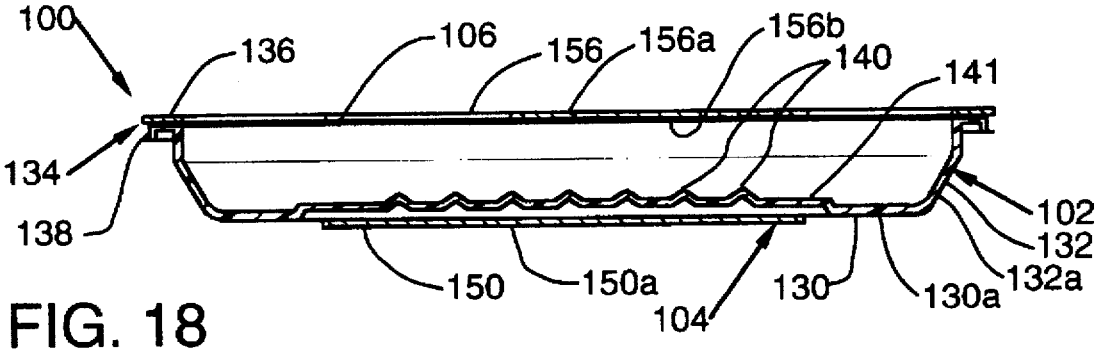
FIG. 18 is a cross-sectional view taken along line 18—18 of FIG. 12.

The sleeve 104 includes a bottom section 150 disposed adjacent an outer surface 130*a* of the base 130, two side sections 152 and 154 disposed adjacent to two separate portions of the outer surface 132*a* of sidewall 132 and a top section 156. The top section 156 defines two openings 158 and 160 which allow visual access to the interior of the food package 100 when the food package is assembled as is shown in FIG. 11. The top section 156 includes an outer surface 156*a* and an inner surface 156*b*. As with the embodiment shown in FIGS. 1–9, indicia such as "FOOD PACKAGE" 162 can be provided on the outer surface 156*a* of top section 156 as well as indicia such as "NUTRITIONAL INFORMATION" 164 and "COOKING INSTRUCTIONS" 166 can be printed on the outer surface 150*a* of bottom section 150.

The clear plastic film 106 can be secured to tray 102 by different methods. One method involves making the film of polyester with an adhesive (such as an adhesive film made by DuPont) and merely heat sealing the film 106 to the tray 102. Another method involves applying an adhesive to flat upper surface 136*a* and then securing a non-adhesive (and thus less expensive) film 106 to the tray 102 by means of the adhesive. Another method involves providing a plastic film having an adhesive on both sides thereof to allow securement of the plastic film 106 to the tray 102 and simultaneous securement of the sleeve 104 to the film 106. The adhesive can be, preferably, a heat activated adhesive. Once the plastic film 106 is secured to the tray 102, the sleeve 104 can be slid over the tray 102 containing the film 106. As with sleeve 24, one embodiment provides that sleeve 104 can have a hot melt adhesive applied directly to the inner surface 156*b* of the top section 156, and can be secured to the film 106 by means of a heat sealing die.

The sleeve 104 can be provided with tear strips 172 and 174 provided on side sections 152 and 154, as is shown in FIGS. 10, 11, 16 and 17. Removing the tear strips 172 and 174 will remove sections 152 and 154 as well as bottom section 150.

In accordance with an advantage of the invention, the top section 156 and clear plastic film 106 can be removed in different ways to facilitate the needs and uses of the food package 100. In one embodiment, the adhesive used to secure the film 106 to the tray 102 (either the adhesive used on the plastic film or the adhesive first applied to the tray 102 and used to secure the non-adhesive film 106 thereto) can bond the film 106 to the tray 102 more strongly than the adhesive that bonds the top portion 156 of the sleeve 104 to the film 106. In this way, the top portion can be removed from the tray without removing the film 106. Conversely, the adhesive used to secure the film 106 to the tray 102 can bond the film 106 to the tray 102 less strongly than the adhesive that bonds the top portion 156 of the sleeve 104 to the film. Thus, in this way, the top portion 156 and the plastic film 106 are both removed from the tray when the top portion 156 is removed.

It will be appreciated that a food package (in several different embodiments) has been provided which is highly functional yet aesthetically pleasing.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A food package for containing a food product, said food package comprising:

a plastic tray having a base with an outer surface and an inner surface and a sidewall extending from said base, said sidewall having an outer surface and an inner surface and defining a tray opening and said sidewall further including a flange having a first portion extending generally perpendicularly from said sidewall; and a paperboard sleeve including (i) a bottom section disposed adjacent said outer surface of said base; (ii) a side section disposed adjacent said outer surface of said sidewall; and (iii) a top section adhesively secured to said first portion of said flange of said sidewall, said top portion substantially covering said tray opening.

2. The food package of claim 1, wherein said flange includes a second portion extending generally perpendicularly from said first portion.

3. The food package of claim 1, wherein said sleeve includes indicia printed thereon.

4. The food package of claim 3, wherein said indicia is printed on said bottom section.

5. The food package of claim 1, wherein said side section includes a tear strip wherein pulling said tear strip away from said sleeve causes said bottom section and said side section of said sleeve to be separated from said tray.

6. The food package of claim 5, wherein said sleeve has a pair of side sections, at least one of said side sections includes said tear strip.

7. The food package of claim 6, wherein each of said side sections includes a said tear strip.

8. The food package of claim 1, wherein said plastic material is selected from the group consisting of polypropylene and crystallized polyethylene terephlalate.

9. The food package of claim 4, wherein said indicia printed on said bottom section of said sleeve includes nutritional information.

10. The food package of claim 4, wherein said sleeve is continuous and encircles said tray.

11. A food package for containing a food product, said food package comprising:

a plastic tray having a base with an outer surface and an inner surface and a sidewall extending from said base, said sidewall having an outer surface and an inner surface and defining a tray opening and said sidewall further including a flange having a first portion extending generally perpendicularly from said sidewall;

a plastic film adhesively secured to said first portion of said flange of said sidewall, said plastic film substantially covering said tray opening; and a paperboard sleeve including (i) a bottom section disposed adjacent said outer surface of said base; (ii) a side section disposed adjacent said outer surface of said sidewall; and (iii) a top section adjacent to and adhesively secured to said plastic film adjacent to said first portion of said flange of said sidewall.

12. The food package of claim 11, wherein said flange includes a second portion extending generally perpendicularly from said first portion.

13. The food package of claim 11, wherein said plastic film is secured to said tray by a first adhesive.

14. The food package of claim 13, wherein said first adhesive is applied to said tray before securing said plastic film thereto.

15. The food package of claim 11, wherein said first adhesive is applied to said plastic film before said plastic film is secured to said tray.

16. The food package of claim 15, wherein said top section includes a second adhesive which secures said top section to said plastic film.

17. The food package of claim 16, wherein said first adhesive bonds said plastic film more strongly to said tray than said second adhesive bonds said top portion to said plastic film so that said top portion can be removed from said tray without removing said plastic film.

18. The food package of claim 16, wherein said first adhesive bonds said plastic film less strongly to said tray than said second adhesive bonds said top portion to said plastic film so that said top portion and said plastic film are removed from said tray when said top portion is removed from said tray.

19. The food package of claim 11, wherein said plastic film includes an adhesive on both sides thereof so that said plastic film is adhesively secured to said tray and said top section of said sleeve is adhesively secured to said plastic film.

20. The food package of claim 11, wherein said plastic film is transparent; and said top section defines openings so that said food product may be viewed in said food package before removal of said sleeve from said food package.

21. The food package of claim 11, wherein said side section includes a tear strip wherein pulling said tear strip away from said sleeve causes said bottom section and said side section of said sleeve to be separated from said tray.

22. The food package of claim 21, wherein said sleeve has a pair of side sections, at least one of said side sections includes said tear strip.

23. The food package of claim 22, wherein each of said side sections includes a said tear strip.

24. The food package of claim 11, wherein said sleeve includes indicia printed thereon.

25. The food package of claim 24, wherein said indicia is printed on said bottom section.

26. The food package of claim 11, wherein said plastic material is selected from the group consisting of polypropylene and crystallized polyethylene terephlalate.

27. The food package of claim 11, wherein said plastic film is a polyester film.

28. The food package of claim 24, wherein said indicia printed on said bottom section of said sleeve includes nutritional information.

29. The food package of claim 11, wherein said sleeve is continuous and encircles said tray.

30. A food package for containing a food product, said food package comprising:

a tray having a base with an outer surface and an inner surface and a sidewall extending from said base, said sidewall having an outer surface and an inner surface and defining a tray opening;

a plastic film adhesively secured to said tray by a first adhesive, said plastic film substantially covering said tray opening;

a sleeve including (i) a bottom section disposed adjacent said outer surface of said base; (ii) a side section disposed adjacent said outer surface of said sidewall; and (iii) a top section adjacent to and adhesively secured to said plastic film; and wherein said first adhesive bonds said plastic film to said tray opening at a different bonding strength than said second adhesive bonds said top section to said plastic film.

31. The food package of claim 30, wherein said first adhesive bonds said plastic film more strongly to said tray than said second adhesive bonds said top portion to said plastic film so that said top portion can be removed from said tray without removing said plastic film.

32. The food package of claim 31, wherein said first adhesive bonds said plastic film less strongly to said tray than said second adhesive bonds said top portion to said plastic film so that said top portion and said plastic film are removed from said tray when said top portion is removed from said tray.

33. The food package of claim 30, wherein said plastic film includes an adhesive on both sides thereof so that said plastic film is adhesively secured to said tray and said top section of said sleeve is adhesively secured to said plastic film.

34. The food package of claim 30, wherein said plastic film is transparent; and said top section defines openings so that said food product may be viewed in said food package before removal of said sleeve from said food package.

35. The food package of claim 30, wherein said side section includes a tear strip wherein pulling said tear strip away from said sleeve causes said bottom section and said sidewall section of said sleeve to be separated from said tray.

36. The food package of claim 35, wherein said sleeve has a pair of side sections, at least one of said sidewall sections includes said tear strip.

37. The food package of claim 36, wherein each of said side sections includes a said tear strip.

38. The food package of claim 30, wherein said sleeve includes indicia printed thereon.

39. The food package of claim 38, wherein said indicia is printed on said bottom section.

40. The food package of claim 30, wherein said tray is made of a plastic material.

41. The food package of claim 40, wherein said plastic material is selected from the group consisting of polypropylene and crystallized polyethylene terephlalate.

42. The food package of claim 30, wherein said plastic film is a polyester film.

43. The food package of claim 30, wherein said sleeve is made of paperboard.

44. The food package of claim 30, wherein said sleeve is continuous and encircles said tray.

45. The food package of claim 30, wherein said sidewall includes a flange.

46. The food package of claim 45, wherein said flange includes a first portion extending generally perpendicularly from said sidewall and a second portion extending generally perpendicularly from said first portion.

* * * * *